US011515634B1

(12) United States Patent
Rivera et al.

(10) Patent No.: US 11,515,634 B1
(45) Date of Patent: Nov. 29, 2022

(54) WIDEBAND LOW VISIBILITY ANTENNA

(71) Applicant: The United States of America as represented by the Secretary of the Navy, Newport, RI (US)

(72) Inventors: David F Rivera, Westerly, RI (US); Connor P Walsh, Newport, RI (US)

(73) Assignee: The United States of America as represented by the Secretary of the Navy

( * ) Notice: Subject to any disclaimer, the term of this patent is extended or adjusted under 35 U.S.C. 154(b) by 0 days.

(21) Appl. No.: 17/400,251

(22) Filed: Aug. 12, 2021

(51) Int. Cl.
*H01Q 9/38* (2006.01)
*H01Q 1/20* (2006.01)

(52) U.S. Cl.
CPC ..... *H01Q 9/38* (2013.01); *H01Q 1/20* (2013.01)

(58) Field of Classification Search
CPC .. H01Q 9/38; H01Q 1/20; H01Q 1/36; H01Q 1/44; H01Q 1/48; H01Q 1/50; H01Q 9/40; H01Q 9/42; H01Q 9/44; H01Q 9/46; H01Q 7/00; H01Q 1/12
See application file for complete search history.

(56) References Cited

U.S. PATENT DOCUMENTS

| | | | | |
|---|---|---|---|---|
| 2006/0022883 | A1* | 2/2006 | Vincent | H01Q 9/16 343/722 |
| 2017/0025750 | A1* | 1/2017 | Su | H01Q 1/50 |
| 2017/0025766 | A1* | 1/2017 | Su | H01Q 1/36 |
| 2021/0050648 | A1* | 2/2021 | Ghezzo | H01Q 9/38 |

OTHER PUBLICATIONS

Shearin, A.E., Madison, S.V., and Colvin, W.S., Soil Survey of Newport and Bristol Counties, Rhode Island, Report, date 1942, pgs. i-65, No. 18, US Dept, of Agriculture, USA.
Scott, J. H. Electrical and Magnetic Properties of Rock and Soil Geological Survey, Report, date 1983, pp. 1-39, US Dept, of Interior, USA.
International Telecommunication Union (ITU), Electrical Characteristics of the Surface of the Earth, Jun. 2017, pp. 1-19, USA.
Schwartz, D.M., Lagrone, A.H., Antenna and Radio Wave Propagation Characteristics at VHF Near and In the Ground, Report, Jun. 30, 1963, pp. 1-43, Air Force Cambridge Research Laboratories, USA.

* cited by examiner

*Primary Examiner* — Dimary S Lopez Cruz
*Assistant Examiner* — Michael M Bouizza
(74) *Attorney, Agent, or Firm* — James M. Kasischke; Michael P. Stanley

(57) ABSTRACT

An antenna is provided with a wire loop having a tapered end with the antenna perpendicular to a base plate. Insulating rods extend from the plate to lock the loop. Wire radials are directed horizontally and circumferentially from the metal base plate to metal stakes secured in a terrain. The base plate is part of a transmission line assembly that also includes a clamp, an S-shaped plate, an input jack and an L-shaped standoff insulator. The antenna is powered from the input jack to the loop. A beam pattern is generated by the loop section, base plate, wire radials and the Earth. Deviation of the beam pattern depends on soil properties of the terrain. To transfer power when the antenna is mounted on a terrain with unknown dielectric properties; a compensation network is provided.

8 Claims, 29 Drawing Sheets

Elevation Beam Pattern

WIDEBAND LOW VISIBILITY ANTENNA

STATEMENT OF GOVERNMENT INTEREST

The invention described herein was made in the performance of official duties by employees of the United States Department of the Navy and may be manufactured, used, or licensed by or for the Government of the United States of America for any governmental purpose without payment of any royalties thereon.

BACKGROUND OF THE INVENTION

1) Field of the Invention

The present invention is directed to a portable and lightweight tactical communications antenna that can receive and transmit over a wide band of frequencies without the antenna requiring tuning adjustments.

2) Description of the Related Art

Antennas for line-of-sight tactical communications in the frequency range of 30 MHz to 88 MHz are vertically-orientated dipoles or monopoles (whips) that are deployed and used in numerous ways.

In one type of deployment, a rear or side panel mounted whip is attached to a vehicle. This method of antenna mounting is common as the whip antenna permits communication when the vehicle is in transit. The counterpoise or return path for currents to close the electromagnetic circuit of the antenna includes the metal body of the vehicle and the terrain beneath the vehicle.

In another deployment, a pole or mast-mounted dipole and wideband antenna is hoisted above the ground (typically 30 feet) to establish a stationary communications base. The antenna also can be a man-pack whip antenna in which the antenna is a thin metal blade connected to a radio frequency of a portable transceiver. The transceiver/antenna combination permits on-the-move communication.

The antenna can also be tripod-mounted at a short distance above the terrain. The tripod-mounted antenna is a dipole antenna encompassed by a protective dielectric shell (radome) with the bottom end of the antenna mechanically attached to a tripod. The tripod-mounted antenna is a low-profile alternative to the mast-mounted dipole with the advantage of being transportable.

The above-identified antennas are typical in that the antennas are used for routine in-the-field radio traffic. However, improvements to durability, portability, reception clarity and transmission clarity are always being sought.

SUMMARY OF THE INVENTION

It is therefore a primary object and general purpose of the present invention to provide a portable and lightweight tactical communications antenna that can be rapidly deployed by a single operator.

To attain the object of the invention, an antenna is provided with geometric shaping and materials to produce a lightweight device with enhanced performance.

The antenna includes a vertically-orientated rectangular loop section with a taper which faces a base plate. Two rods extending from the base plate lock the loop section in the vertical orientation. At least eight thin wire radials extend horizontally from the base plate to a circumference surrounding the base plate. The other end of each wire connects to a metal stake. The stakes secure the wire radials and the base plate to the terrain of the Earth.

The base plate provides a stable and low center-of-gravity for mounting the antenna on an uneven terrain; acts as a connection hub for the wire radials; and acts as the lower half of a transmission line assembly for energizing the vertical loop section. The upper half of the transmission line assembly to the loop section includes a metal clamp, an S-shaped metal plate and an L-shaped standoff insulator. The plate is soldered to an input jack and the clamp secures the loop section to the transmission line assembly.

The radiating portion of the antenna is the closed metal loop section. The loop width and taper angle proportions present an antenna impedance at the input jack to a level that matches to a transceiver.

In a transmitting or receiving operation, the antenna beam pattern is generated by currents and voltages set up over the loop section, the base plate, the wire radials and the Earth. The interaction between these elements form a closed circuit that the transceiver recognizes as an electrical load with a complex-valued impedance that changes with frequency.

When the circuit is applied with the antenna mounted on the Earth; deviation depends on the soil properties of the terrain of the Earth. After examining the feed point impedance of the antenna over other types of soil; a baseline equivalent circuit can be modified.

The equivalent circuit illustrates the manner in which a feed point impedance of the antenna is seen by a transceiver. In order to transfer maximum power to and from the transceiver when the antenna is mounted on terrain with unknown dielectric properties; a compensation network is needed. To provide this network; the limits of the dielectric properties of soil must be known.

A matching network can connect between the antenna and the transceiver to electrically match the antenna and the transceiver in order to transfer maximum power in the presence of any soil type. If the matching circuit were not there, the antenna would still work, but not consistently because the soil would alter the antenna impedance (R+j X) characteristics.

For example, the antenna without the matching circuit might work better in wet soil and worse over rocky soil (by better or worse, the antenna might radiate more power when over wet soil and less over rocky soil, which translates to communication range). By using the circuit, power transfer between antenna and transceiver is maximized so that communication range becomes more consistent regardless of soil type.

The influence of soil on feed point impedance generates a series of impedance compensation (or matching) networks. The compensation network comprises a resistor and co-axial transmission lines having different lengths and impedances. The network helps match the antenna to the transceiver with comparatively low Voltage Standing Wave Ratio results.

Voltage Standing Wave Ratio (VSWR) is a number that describes how well matched the antenna is to the transceiver for maximum power transfer. A value of one (1) is a perfect match but this is an idealization. Since the antenna is to be used over any soil type, the circuit that matches the antenna to the transceiver within a certain limit.

In operation, the antenna is deployed and activated with a transceiver. Either as a standalone or with an operator, the antenna is lightweight, easily deployed, simple to construct and not easily visible.

BRIEF DESCRIPTION OF THE DRAWINGS

Features of illustrative embodiments may be understood from the accompanying drawings in conjunction with the detailed description. The elements in the drawings may not be drawn to scale. Some elements and/or dimensions are enlarged or minimized for the purpose of illustration and the understanding of the disclosed embodiments.

DETAILED DESCRIPTION OF THE INVENTION

The invention summarized above is better understood by referring to the following description, which is read in conjunction with the accompanying drawings in which like reference numbers are used for like parts. This description of an embodiment, set out below to enable one to practice an implementation of the invention, is not intended to limit the preferred embodiment, but to serve as a particular example thereof.

Figure 1:
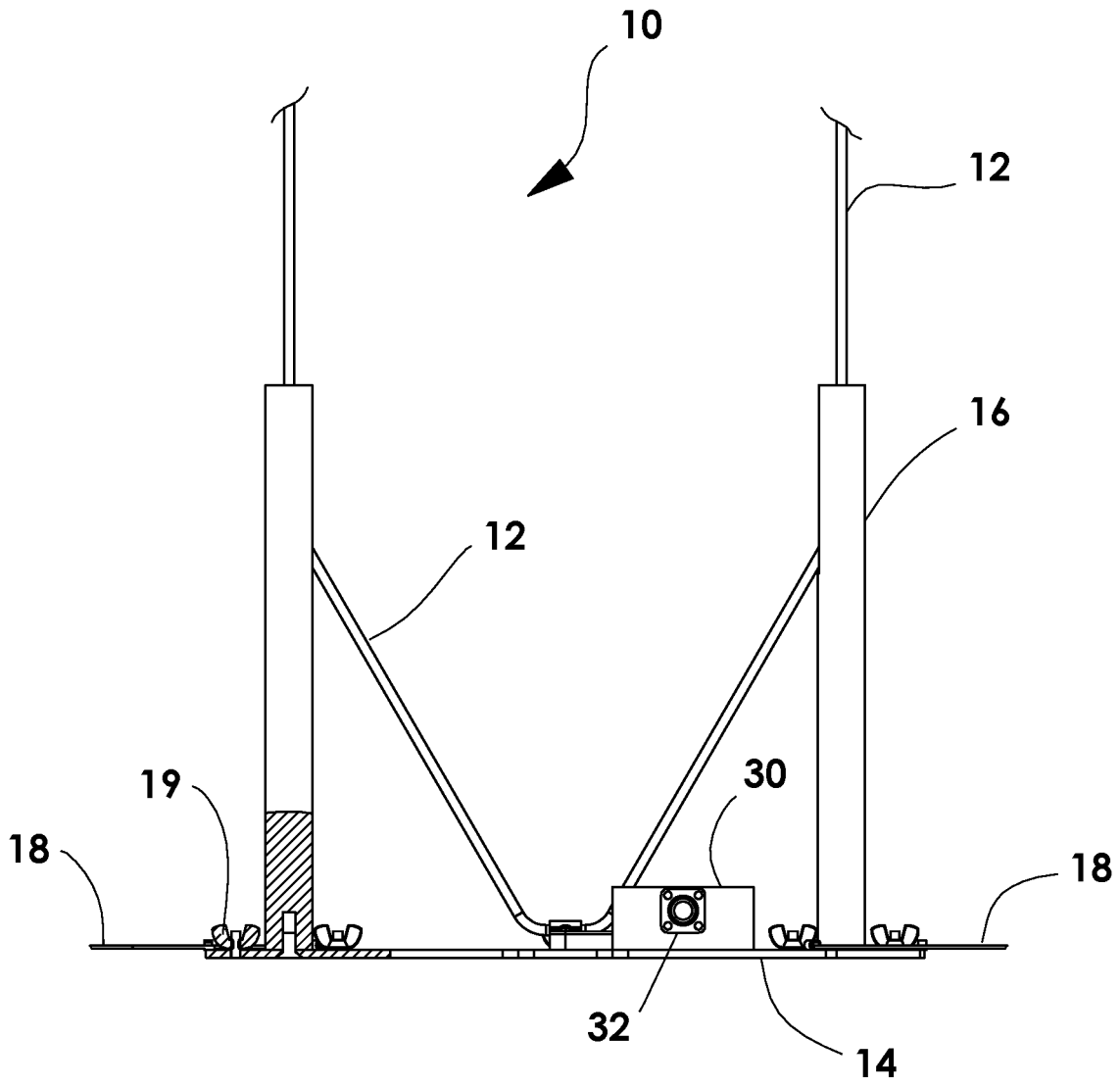
FIG. 1 depicts a side view of a rapid-deployment antenna of the present invention.
Figure 2:
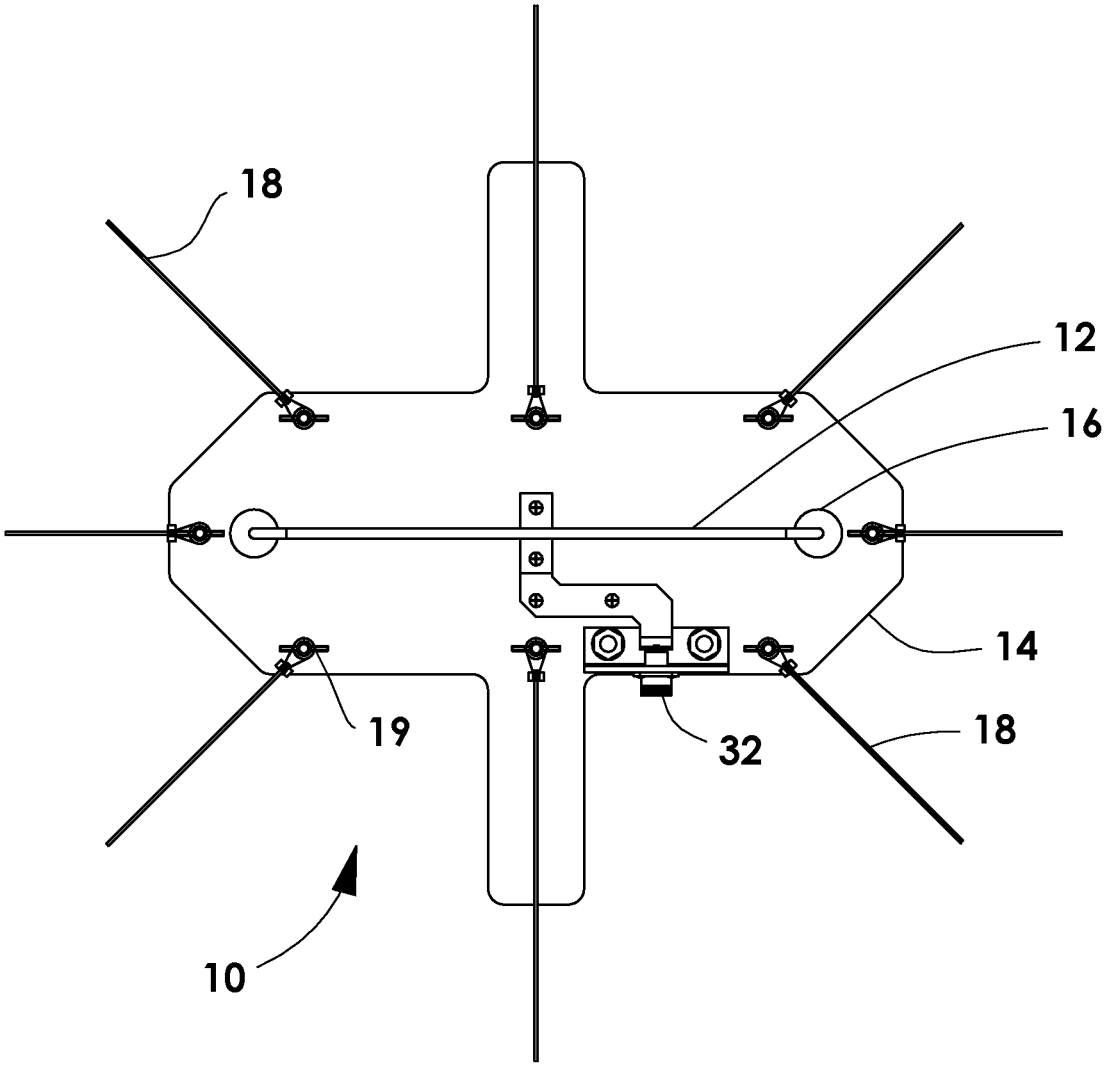
FIG. 2 depicts a top view of the antenna of the present invention.
Figure 3:
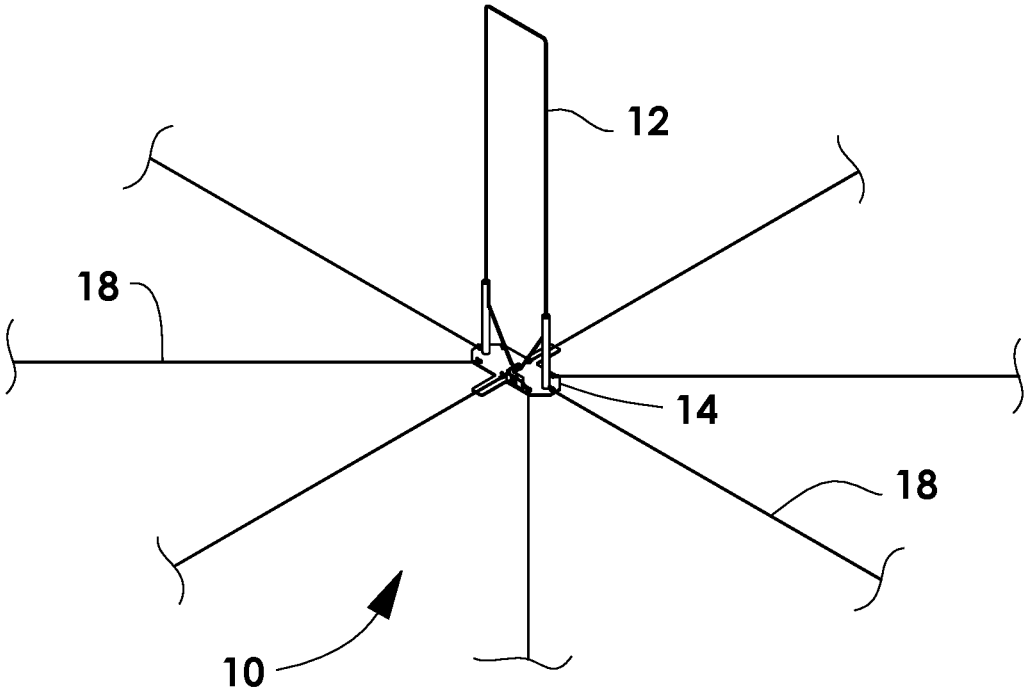
FIG. 3 depicts an isometric view of the antenna with a mounting base and loop energizing-feed subassembly shown.

FIG. 1-3 depict an antenna 10 of the present invention. The antenna 10 includes a vertically-orientated and rectangular loop section 12 with a semi-triangular taper at a bottom end of the loop section. The loop section 12 is formed with round wire. A semi-rectangular metal base plate 14 energizes the loop section 12 while also providing mechanical stability and a low center of gravity when the base is mounted on a terrain. At least two rods 16 made from insulating material (such as FR-4 fiberglass) are supports that vertically lock the loop section 12 into place.

The antenna 10 also includes at least eight thin wire radials 18 attached by wing nuts 19 and extending from the base plate 14. Another end of each of the thin wire radials 18 connects to a short metal stake (not shown). The metal stakes secure the wire radials 18 to the terrain of the Earth.

The metal components of the antenna 10 are aluminum, brass, copper and stainless steel. Depending on how the antenna 10 is used; the antenna can be made in several ways. For repeated and rough operator use; the metal parts of a rugged field version can be made from a nickel-titanium alloy (Nitinol). Nickel-titanium alloy is known for elastic and shape memory properties.

For standalone use, the metal parts may be made from magnesium alloys and the non-conducting (dielectric) parts from Chitosan or crystallized poly lactic acid (cPLA) composites. Employing these materials for the antenna 10 produces a biodegradable device that can break down into non-functional parts when exposed to the weather.

Figure 4:
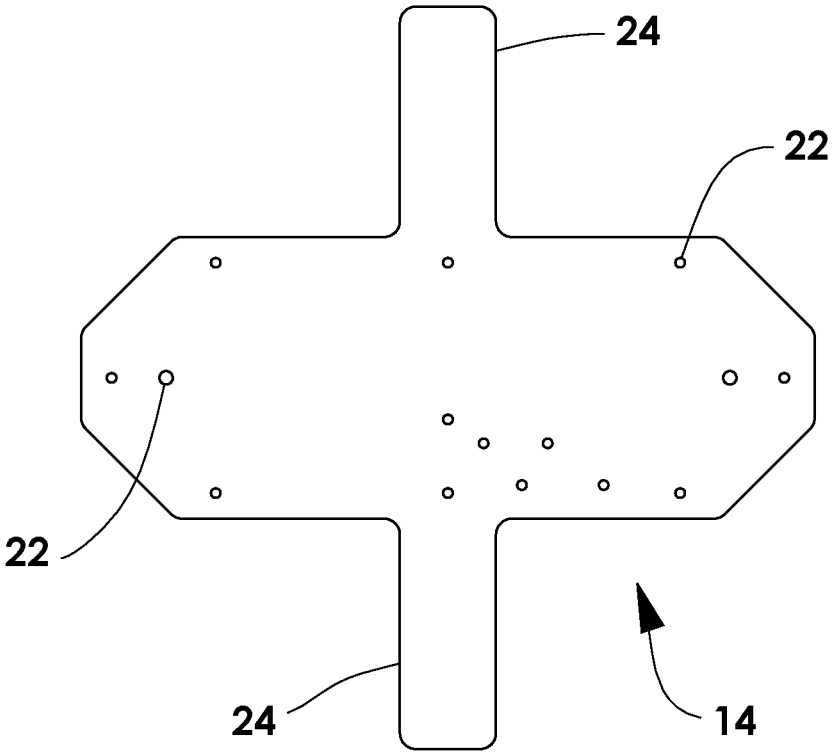
FIG. 4 depicts a base plate of the antenna.

FIG. 4 depicts a top view of the base plate 14 with hole-drilling details shown as apertures 22 as attachment points for the other components of the antenna 10. These are hole drillings and are relevant to this particular base-plate design. The base plate 14 provides a low center-of-gravity for mounting the antenna 10 on an uneven terrain; acts as a connection hub for the wire radials 18; and acts as the lower half of the transmission line assembly for energizing the vertical loop section 12. Rectangular arms 24 protrude from the base plate 14 to further provide stability for the antenna 10. A workable base plate 14 can be fabricated from 0.25 inch thick aluminum.

Figure 5:
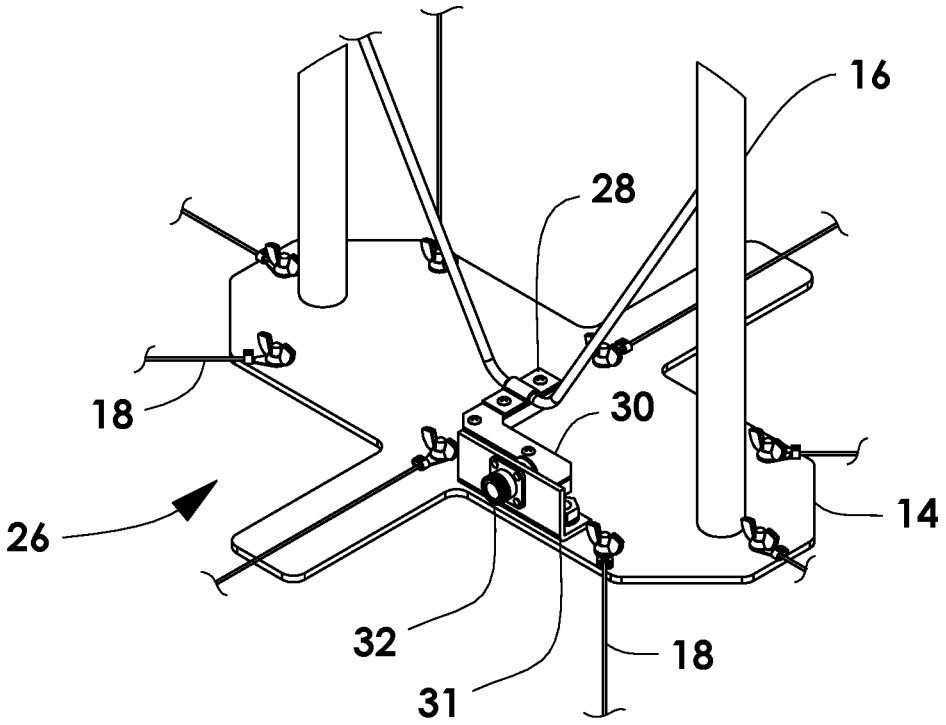
FIG. 5 depicts the feed assembly of the antenna.
Figure 6:
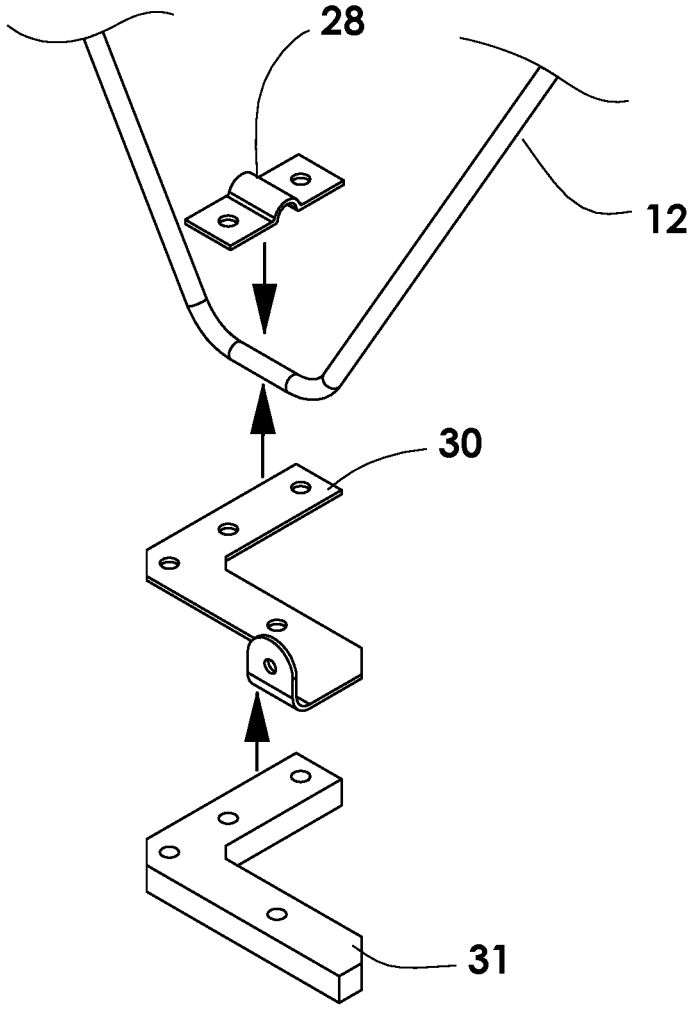
FIG. 6 depicts a breakout view of the feed assembly of the antenna.

In FIG. 5 and in FIG. 6, a feed assembly 26 is shown with a metal (brass) clamp 28, an S-shaped metal (brass) plate 30 and an L-shaped standoff insulator 31. Any low-loss insulator will work, but FR-4 flame retardant fiberglass is preferable because it is a hard and tough material. During assembly, the standoff insulator 31 is fastened to the base plate 14; followed by the S-shaped plate 30. Then, the S-shaped brass plate 30 is fastened to the opposite face; thereby, forming a parallel plate transmission line. One end of the S-shaped plate 30 is connected to the vertical loop to energize the. Standoff indicates that the upper S-shaped brass plate 30 was separated or "stood" off from the lower aluminum base plate by the insulator. One end of the S-shaped plate 30 is an up-turned tab that solders to a center pin of an input jack 32 for powering the antenna 10.

The S-shaped plate 30, the L-shaped standoff insulator 31 and the base plate 14 form a transmission line that carries power from the input jack 32 to the tapered region of the loop section 12. The metal clamp 28 joins the loop section 12 with the transmission line or assembly. The transmission line is sized to produce a characteristic impedance (ZO) of 50 ohms.

Figure 7:
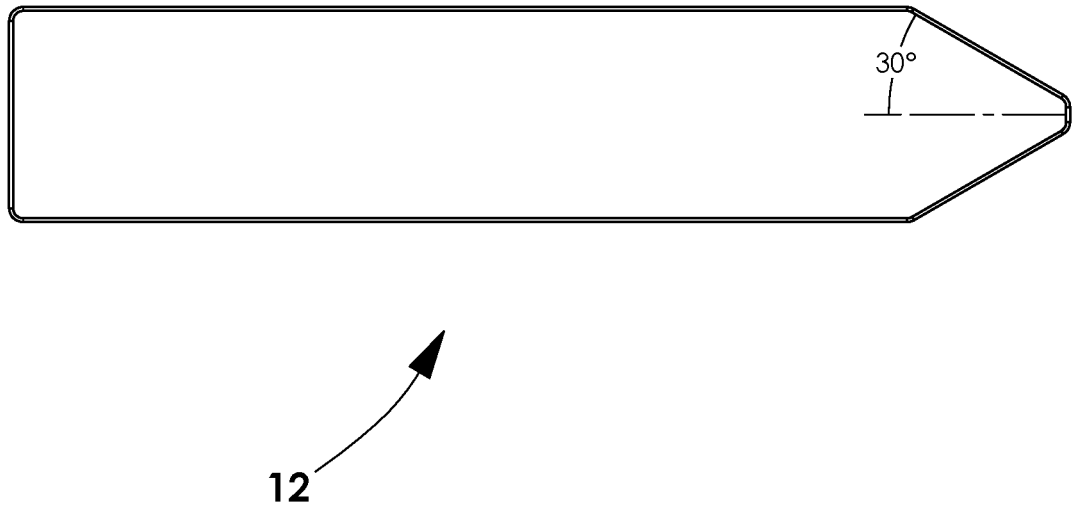
FIG. 7 is a view of the vertical loop section of the antenna.
Figure 8:
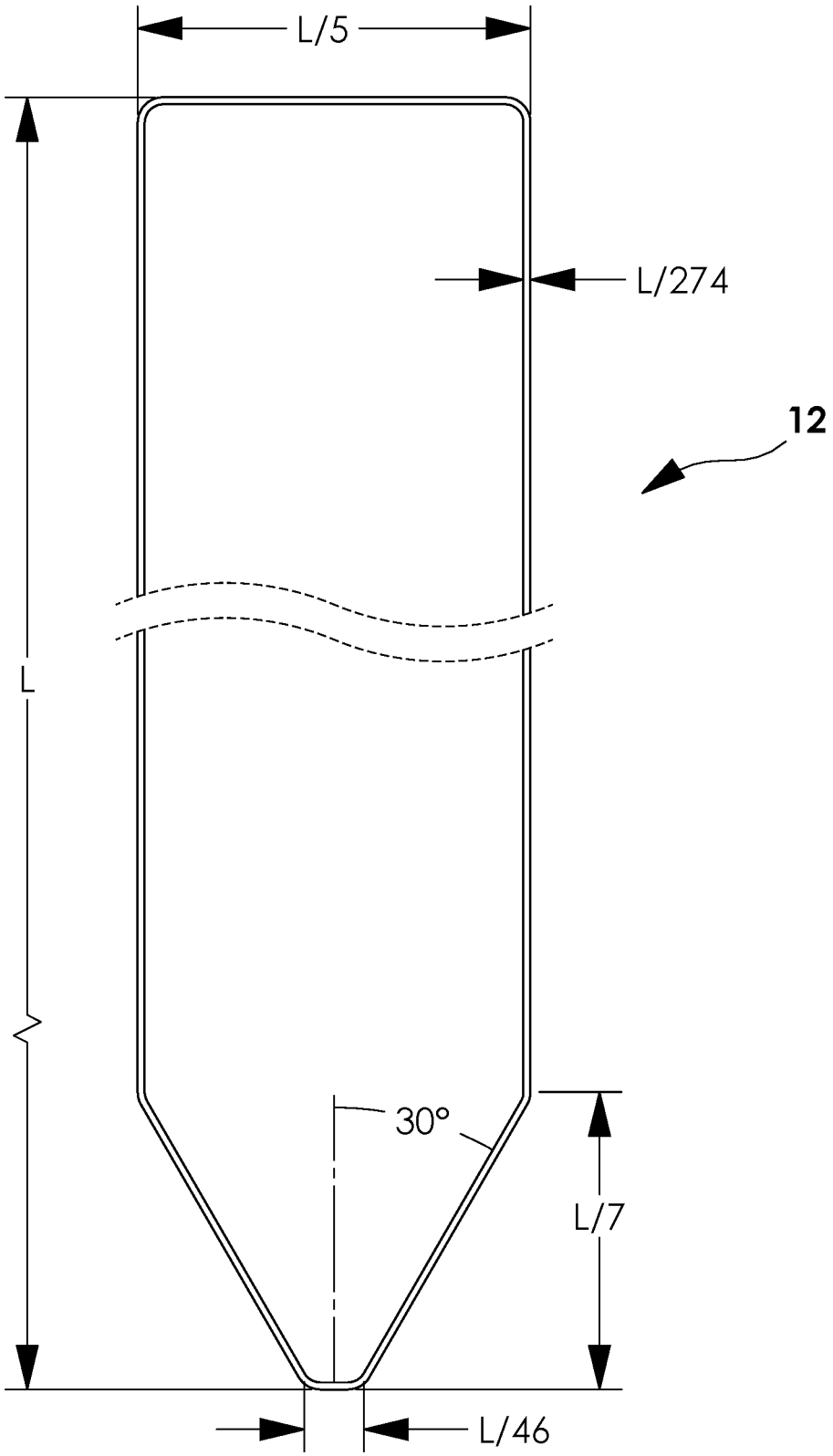
FIG. 8 is a dimensioned view of the vertical loop section.

As shown in FIG. 7 and FIG. 8, the radiating portion of the antenna 10 is the closed metal loop section 12. The wire material of the loop section 12 is preferably stainless steel with a diameter of 0.25 inches. In an example of an operable antenna 10; a tall and wide antenna (68.5 and 13.25 inches respectively) would have the loop section 12 weighing approximately six ounces. The corner radii of the loop section 12 are large (in the example; 0.5 inches) to prevent breakage during fabrication.

The components of the antenna 10 are determined at the wavelength corresponding to the geometric mean frequency of the band ($\lambda_o$) as calculated by Equation (1):

$$\lambda_o = \frac{v_o}{f_o} \tag{1}$$

where $v_o$ is the speed of light ($3\times10^8$ meter/s) and where $f_o$ is the geometric mean frequency (≈52 MHz).

The vertical loop section 12, shown in FIG. 8, provides performance throughout a frequency band of interest. The height dimension is $L\approx0.3\lambda_o$ at the geometric mean frequency. The loop width and taper are fractions of the height L. The height dimension is tall enough to yield a radiation pattern in the horizontal plane with significant power gain. The loop width and feed taper angle proportions present an antenna impedance (Z) at the input jack 32 to a level that can be matched to a transceiver in order to maximize power transfer.

The shape and size of the base plate 14 prevents the antenna 10 from toppling over when the antenna is mounted on an uneven terrain. The area of the base plate 14 is sufficiently large to permit proper spacing of the radials 18 as well as to mechanically stiffen the transmission line of the energizing feed to the vertical loop section 12.

An operating example of the antenna 10 includes dimensions where the length of each radial wire 18 is 1.5 L and the radial wire diameter is L/200. The length of stakes that secure the radial wires 18 to the Earth have a length of L/5 and a diameter of L/540. The length of the radial wires 18 provides a stable radiation pattern, feed point impedance and diameter for flexibility. The ends of the radial wires 18 have alligator clips or other mechanical attaching devices to permit attachment to the ground stakes.

In a transmitting or receiving operation, the beam pattern of the antenna 10 is generated by currents and voltages set up over various length segments of the vertical loop section 12, the base plate 14, the wire radials 18 and the Earth. The interaction between these elements form a closed electromagnetic circuit that the transceiver recognizes as an electrical load with a complex-valued impedance ($Z=R+j\,X$, where $j=\sqrt{-1}$) that changes with frequency. The real part of the complex impedance, the resistance (symbol R), describes that portion of power that radiates into space with a small fraction being dissipated as heat. The imaginary part of the impedance, the reactance (symbol X), describes the non-radiative (or stored) portion of power flow.

Figure 9:
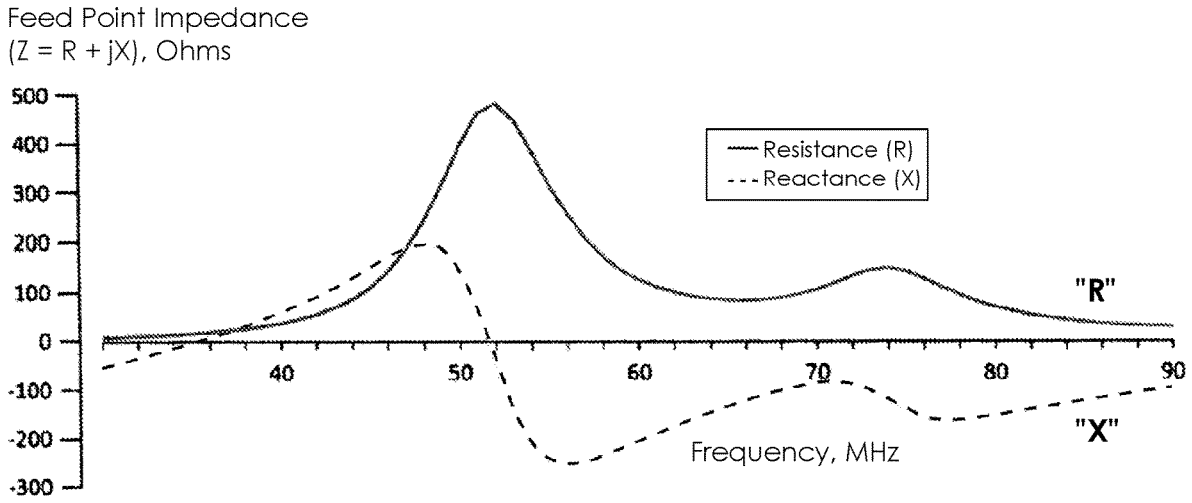
FIG. 9 is a graphical representation of a feed point impedance of the antenna suspended at an infinite distance from the Earth.

To obtain information into what the transceiver electrically recognizes when connected; a hypothetical case is analyzed in which the antenna 10 is placed at an infinite distance from the Earth. The load impedance seen by the transceiver varies with frequency in the manner shown in FIG. 9.

The hypothetical case establishes a baseline for what occurs when the antenna 10 is brought back to Earth. This information can determine a matching circuit when placed between the transceiver and the antenna 10 and permits the maximum transfer of power in and out of the antenna to improve efficiency with any type of soil.

Circuit theory provides that a given impedance (Z) variation with frequency can be represented as a network of elements combining resistance (R), inductance (L) and capacitance (C). The difficulty is finding a particular circuit topology (configuration) that reproduces the given impedance. For the hypothetical antenna, a circuit is presented in FIG. 10. The circuit depicts the peaks and valleys in the resistance R as well as the inflection points in the reactance X as a function of frequency.

Figure 11:
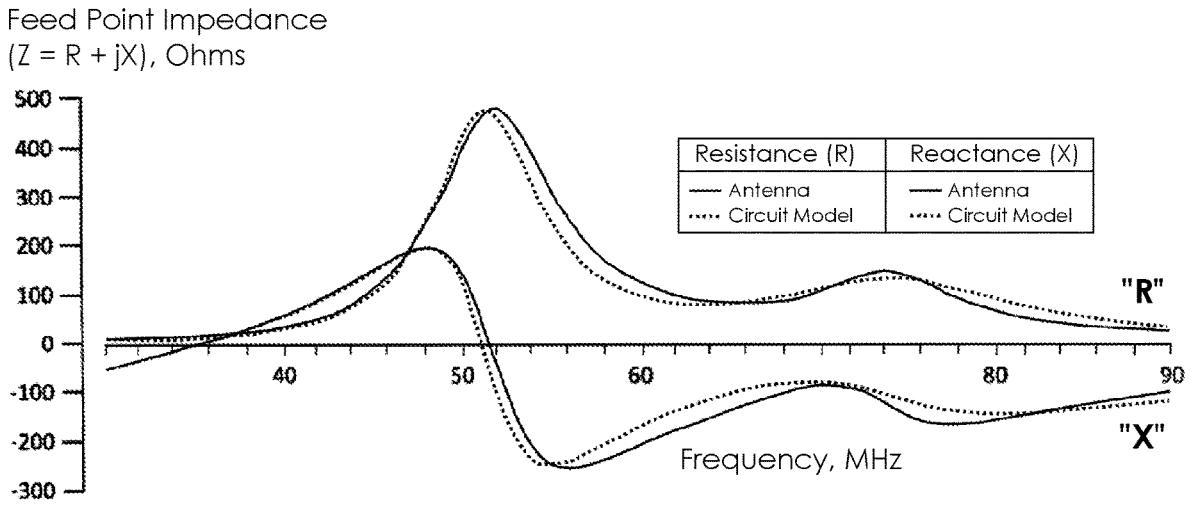
FIG. 11 is a graphical representation of a feed point impedance of an antenna far removed from Earth in comparison with impedance determined with the equivalent of FIG. 10.

With the electrical values for the components of the circuit determined; a comparison plot is shown in FIG. 11. The impedance values produced by the equivalent circuit follow the shape and trend of the impedance curve of the antenna 10.

Figure 10:
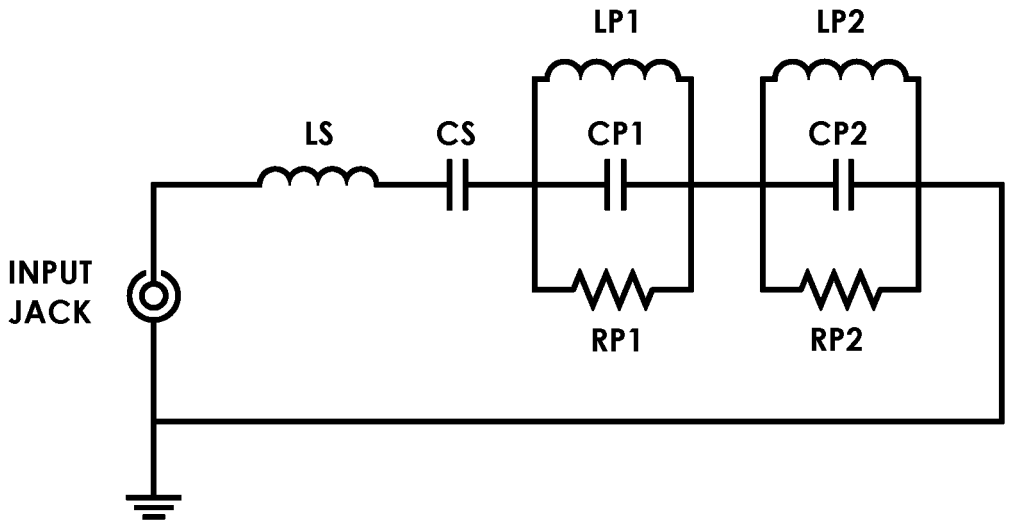
FIG. 10 depicts an equivalent circuit of the antenna of the present invention when the antenna is suspended at an infinite distance from the Earth.

FIG. 11 depicts a feed point impedance of an antenna far removed from earth in comparison with the impedance determined with the equivalent of FIG. 10. The circuit component values are LS=70 nH, CS=39 pF, LP1=200 nH, LP2=58 nH, CP1=48 pF, CP2=79 pF, RP1=475Ω, RP2=122Ω. For the inductive (L) and capacitive (C) circuit element values, the units nH (nano-Henry)=$10^{-9}$ H and pF (pico-Farad)=$10^{-12}$ F.

When the circuit in FIG. 10 is applied with the antenna 10 mounted on Earth; the element values differ significantly from those of the baseline (far from Earth). The deviation depends on the properties of the soil.

Figure 12:
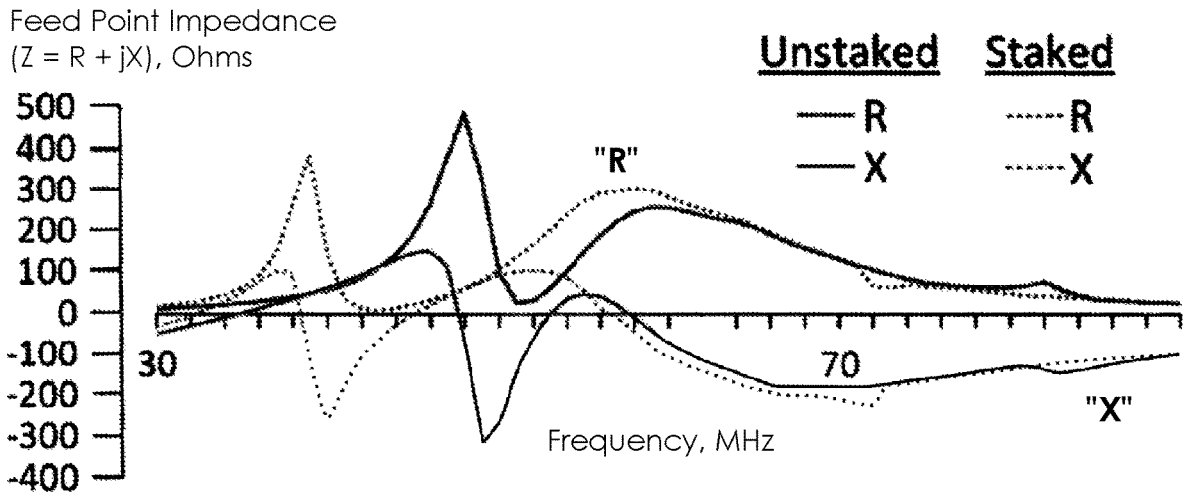
FIG. 12 is a graphical representation of the feed point impedance of the antenna in dry soil.
Figure 13:
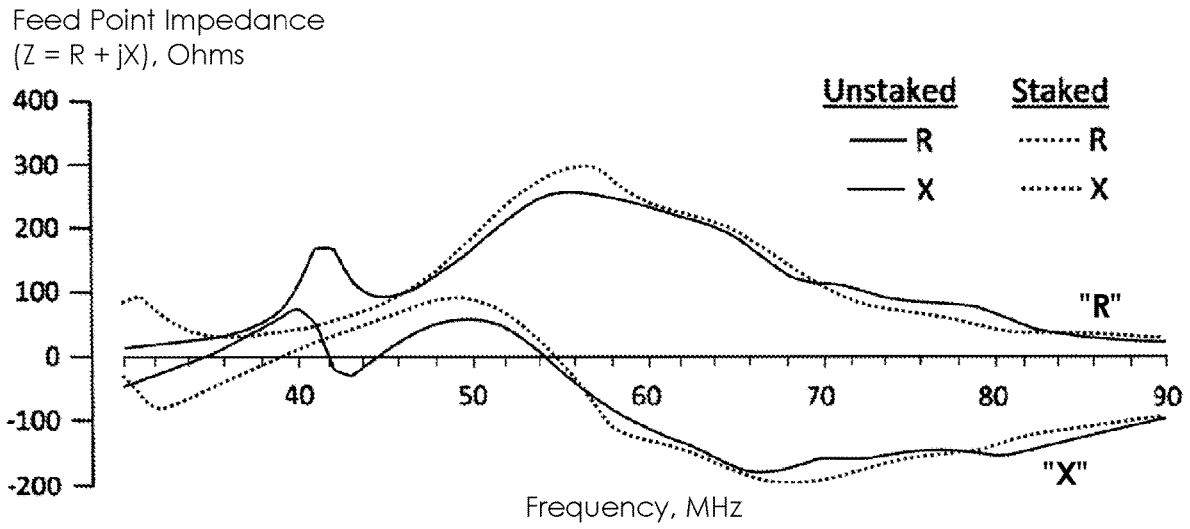
FIG. 13 is a graphical representation of the feed point impedance of the antenna in wet soil.

Examples of feed point impedances Z observed with the antenna 10 are shown in FIG. 12 and FIG. 13. In FIG. 12, the feed point impedance observed with the antenna 10 is shown for dry soil and in FIG. 13, the feed point impedance observed with the antenna is shown for wet soil. The addition of ground stakes at the end of the radial wires 18 causes a shift in the maximum values of R and X to a lower frequency.

Figure 14:
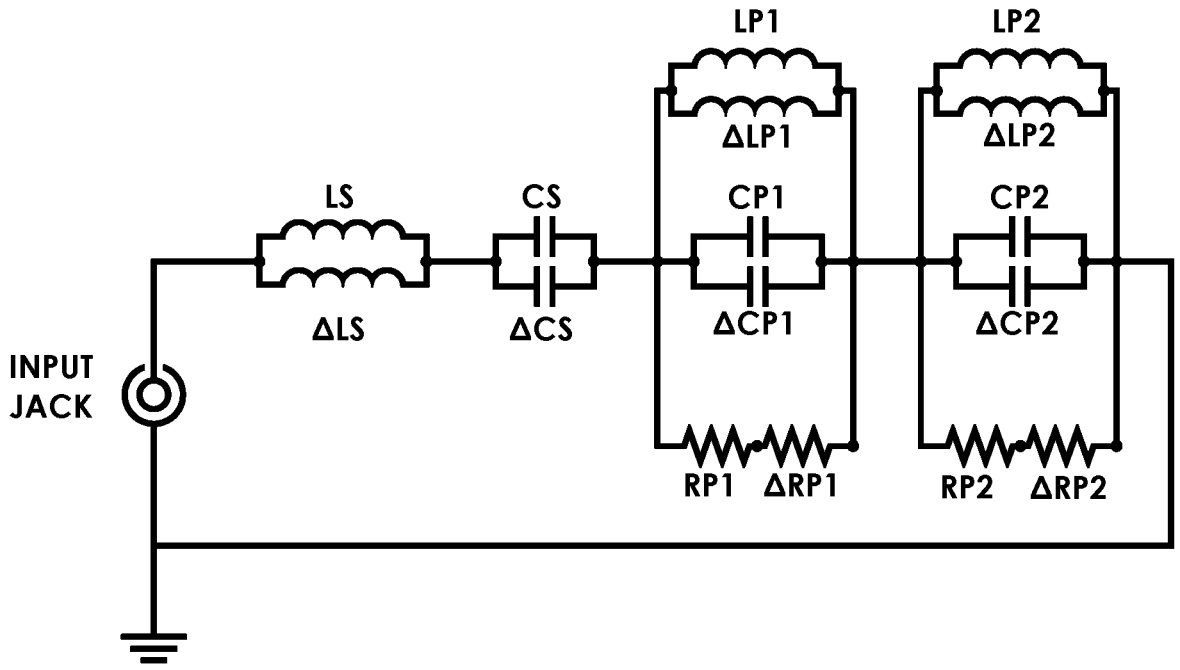
FIG. 14 depicts an antenna equivalent circuit seen by a transceiver when placed on real earth.

After examining the feed point impedance of the antenna 10 over other types of soil (between 30 MHz and 90 MHz); the baseline equivalent circuit of FIG. 10 is modified and has the form shown in FIG. 14. The new circuit depicts the complicated paths taken by the currents and voltages as both are distributed around antenna conductors and through the Earth. The intention is to provide an equivalent circuit of the antenna.

FIG. 14 depicts an approximate antenna equivalent circuit when placed on real earth (with or without ground stakes). The components comprising the baseline circuit (LS, CS, LP1, CP1, RP1, LP2, CP2 and RP2) are augmented by series and parallel circuit elements that represent additional electric and magnetic field flow paths through the Earth (ΔLS, ΔCS, ΔLP1, ΔCP1, ΔRP1, ΔLP2, ΔCP2, ΔRP2). The electrical values of the circuit components perturbing the baseline (ΔR, ΔL, ΔC) depend on soil dielectric properties (dielectric constant and bulk conductivity) and frequency.

The equivalent circuit shown in the figure illustrates the complicated manner in which the Earth modifies a feed point impedance of the antenna 10 is seen by a transceiver (not shown). In order to transfer maximum power to and from the transceiver when the antenna 10 is mounted on terrain with unknown dielectric properties; a compensation network that is able to electrically adjust itself without manual tuning is desirable. To assemble this network; the numerical limits of the dielectric properties of soil must be known.

Soil is generally a mixture of four components. Clay is the smallest particle in soil with a diameter of less 0.08 mil (one mil=1/1000 inch) and a mass density of 0.77 oz/in$^3$. Clay contains various amounts of iron, magnesium, silicon dioxides and alkalai metals.

Silt has a diameter larger than 0.08 mil but less than 0.2 mil with a mass density of 0.80 oz/in$^3$. Silt is comprised of quartz and feldspar. Sand is the largest of the particles with a diameter greater than 0.2 mils but less than 8 mils. Sand has a mass density of 0.83 oz/in$^3$ and is made up of finely divided rock and mineral with added amounts of silicon dioxide. The water content of soil ranges from approximately three percent to as high as fifty percent by volume and may contain mineral salts.

The dielectric properties of soil also depend on other factors such as porosity, rocks and vegetation, that varies with depth and temperature. Soil is defined in FIG. 15 in which the figure depicts a United States Department of Agriculture soil texture triangle.

Figure 15:
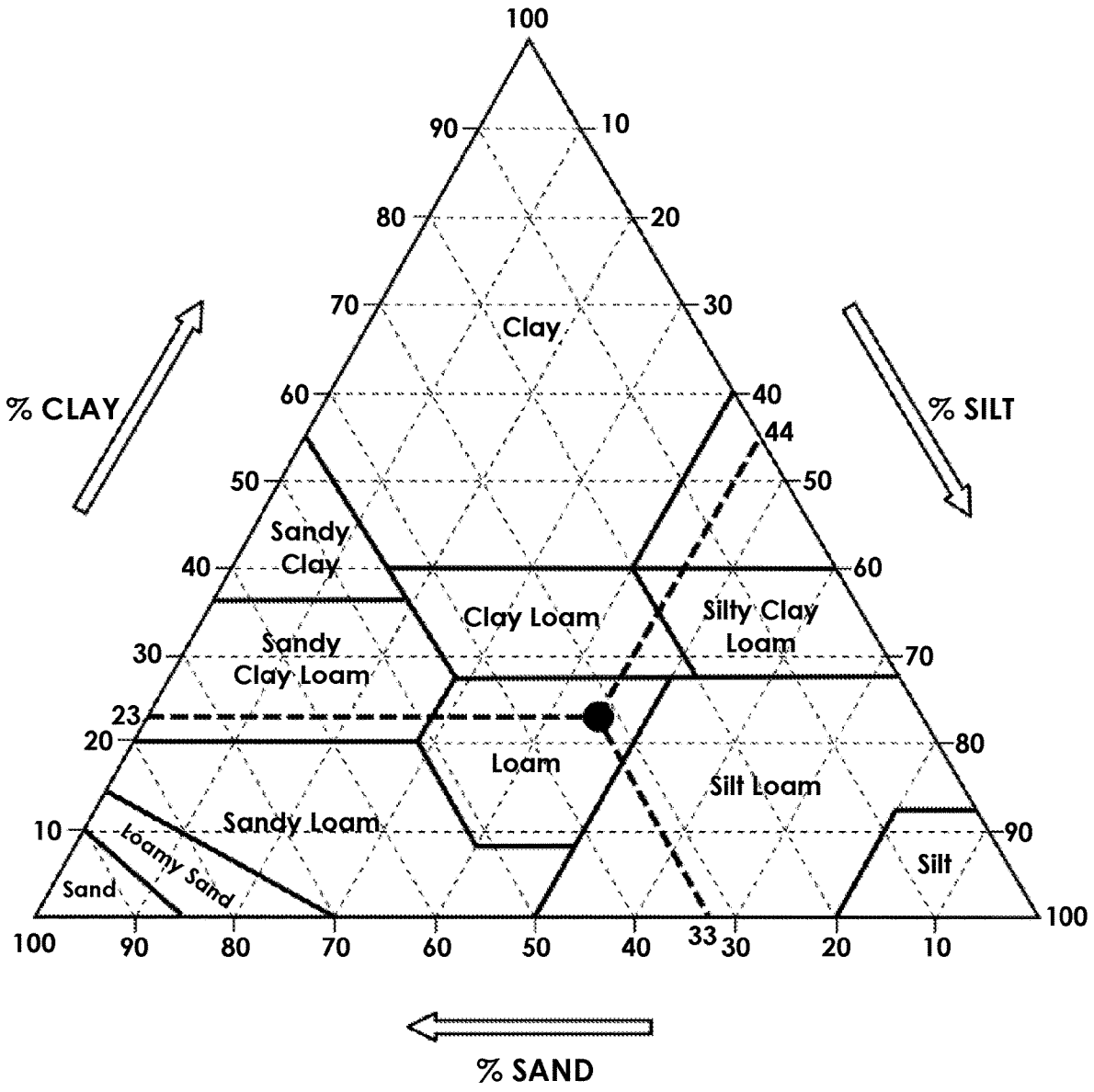
FIG. 15 depicts the United States Department of Agriculture soil texture triangle.

The determination in dotted lines in FIG. 15 was from a sample. The volume fractions of clay, silt and sand is determined by partially filling a glass jar with the soil sample, adding soapy water and then agitating the mixture. After a few days at rest, the constituents resettle in the jar in order of increasing mass density (heaviest at the bottom) to various thicknesses. The volume fraction of each constituent is the ratio of layer thickness to that of the total sample height. For the sample and at the geometric mean frequency of 52 MHz and an ambient temperature of 78 degrees Fahrenheit; the relative dielectric constant ($\varepsilon'$) of the soil is twenty-two with a conductivity ($\sigma$) of 0.025/m.

The relative dielectric constant of soil (Symbol: $\varepsilon'$, no units) could have any value between approximately 3 (desert sand) and 27 (moist loamy soil) while the bulk connectivity (Symbol: $\sigma$, Units: Siemens per meter, S/m) is within the range of $10^{-5}$ to 0.05. TABLE I lists VHF dielectric properties of various soil types.

TABLE I

| Soil Type | Dielectric Constant ($\varepsilon'$) | Bulk Conductivity ($\sigma$), S/m |
|---|---|---|
| Dry | 5 | $10^{-5}$ |
| Wet | 10 | $10^{-3}$ |
| Rocky | 10 | $2 \times 10^{-3}$ |
| Forestation | 13 | $5 \times 10^{-3}$ |
| Rich | 20 | $10^{-2}$ |

Figure 16:
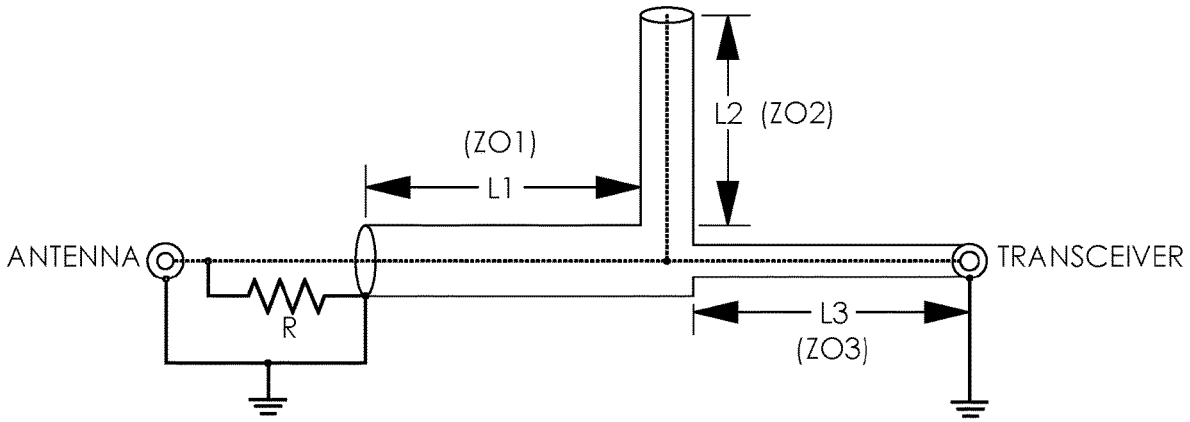
FIG. 16 depicts an antenna matching/soil-type compensation network.

The work on soils and their influence on feed point impedance generates a series of impedance compensation (or matching) networks with varying degrees of complexity. Out of this group, the network in FIG. 16 is the simplest and most effective at matching the antenna 10 to a 50-ohm transceiver under soil conditions considered. TABLE II lists the parts of a matching network in support of FIG. 16.

TABLE II

| Part | Description | Characteristic Impedance, Ω | Length, in. |
|---|---|---|---|
| R | Non-inductive, 470 Ω | — | — |
| ZO1 | Transmission line | 100 | L1 = 18 |

TABLE II-continued

| Part | Description | Characteristic Impedance, Ω | Length, in. |
|---|---|---|---|
| ZO2 | " | 100 | L2 = 10 |
| ZO3 | " | 70 | L3 = 9 |

FIG. 16 depicts an antenna matching/soil-type compensation network with a resistor R and three co-axial transmission lines having different lengths (L1, L2, L3) and characteristic impedances (ZO1, ZO2, ZO3). The far-end transmission line length L2 terminates in an open circuit. Resistor R is a non-inductive type with a value between 330 and 680 ohms. A mass-production version of the antenna can have the network integrated into the mounting base.

The matching network operates when a parallel Za//R places an impedance locus in a Smith chart where the locus is stationary regardless of soil and staked/unstaked radials. A first transmission line rotates load impedance Za//R to a desirable position on the Smith chart (within 4:1 VSWR circle). An open circuit stub then adds a shunt capacitance between 12.5 pF (@30 MHz) and 14.7 pF (90 MHz). A last transmission line transforms a parallel combination of transformed load impedance Za//R and open stub capacitance to within desired limits. The function of resistor R is large enough so that negligible current goes to earth.

Figure 17:
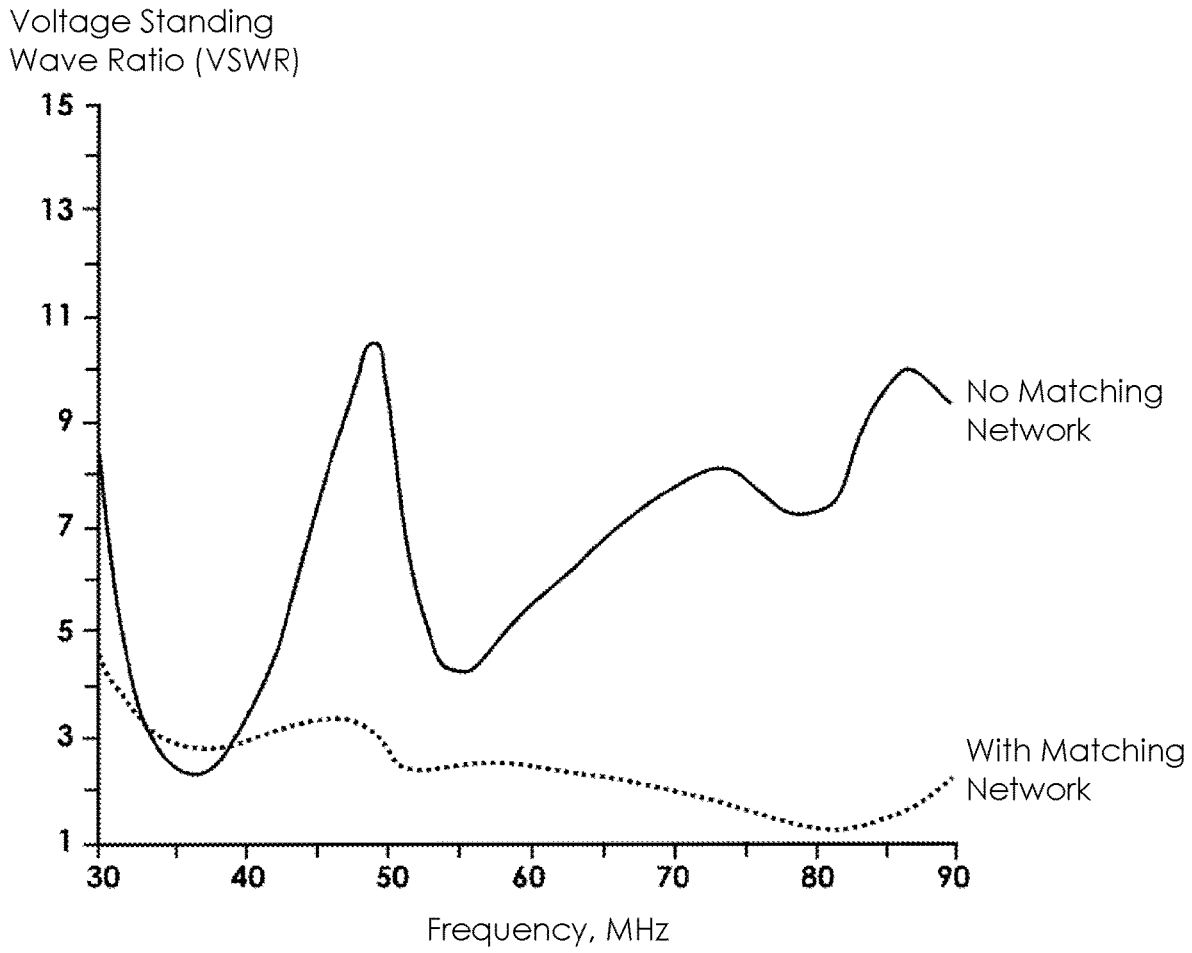
FIG. 17 is a graphical representation of an antenna matching/soil-type compensation network with the antenna of the present invention on dry earth without ground stakes.
Figure 18:
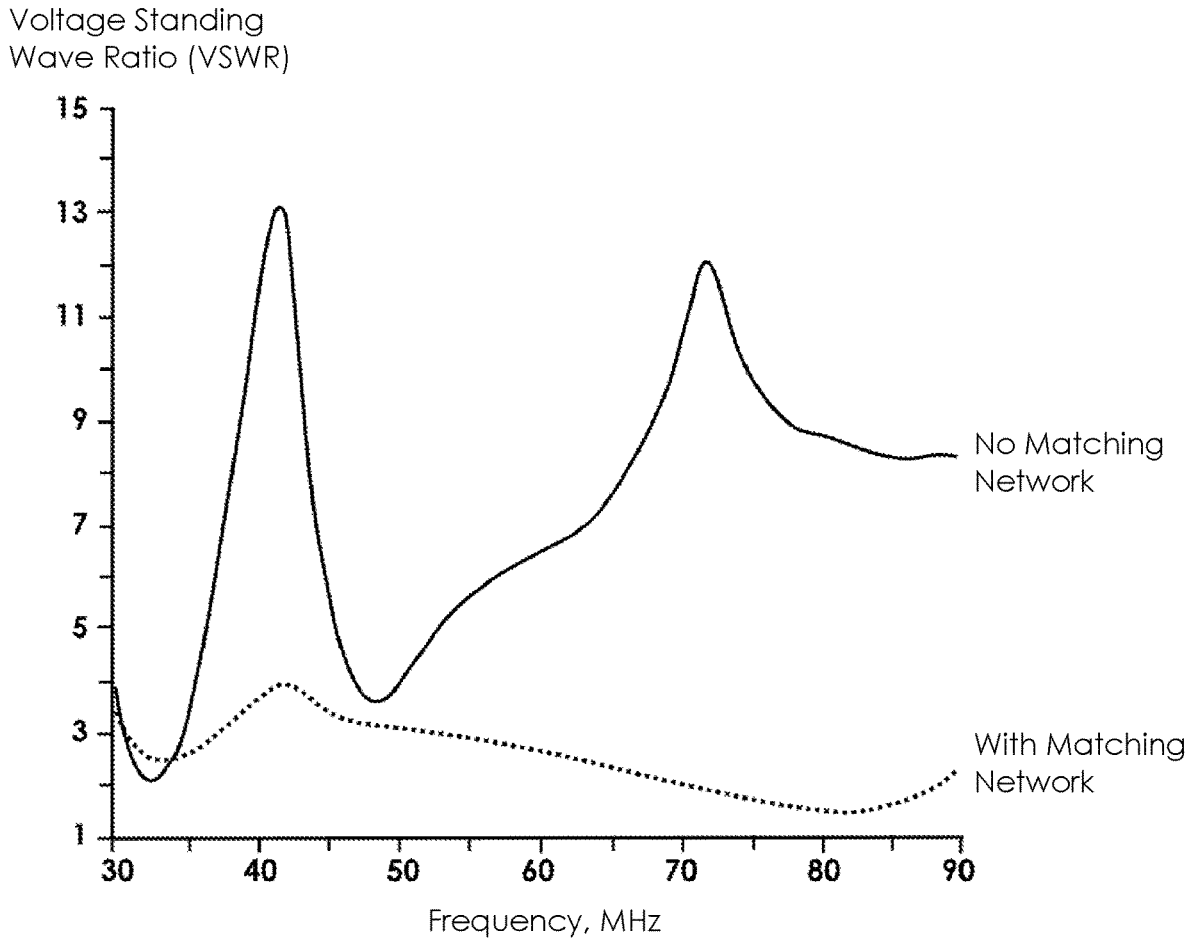
FIG. 18 is a graphical representation of an antenna matching/soil-type compensation network with the antenna of the present invention on dry earth with ground stakes.

FIG. 17 and FIG. 18 demonstrate the behavior of the matching network on dry soil (worst case). As shown in the figures, the network presents a load to the transceiver with a Voltage Standing Wave Ratio (VSWR) of less than 4:1 over a substantial portion of the band. On other soil types, the network matches the antenna to the transceiver with similar or better (lower VSWR) results.

The differences are seen in the dashed line (with matching network) at the lower end of the frequency band, below about 40 MHz. In FIG. 17, the "with matching network" line is higher and in FIG. 18; the matching network is lower; thereby, indicating that for best results, the radials should be staked to obtain a better electrical match to the transceiver at frequencies below 40 MHz.

Figure 19:
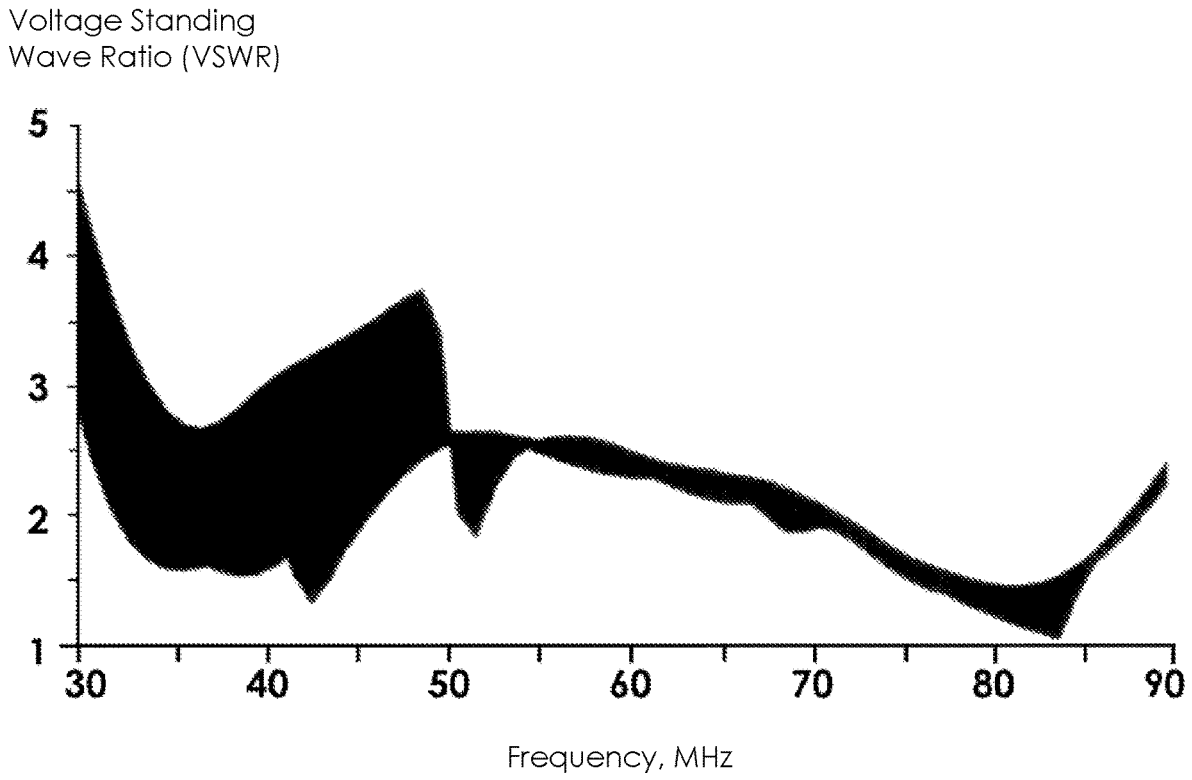
FIG. 19 is a graphical representation of an antenna matching/soil-type compensation network with an envelope of VSWR curves obtained with an un-staked antenna mounted over various soil types.
Figure 20:
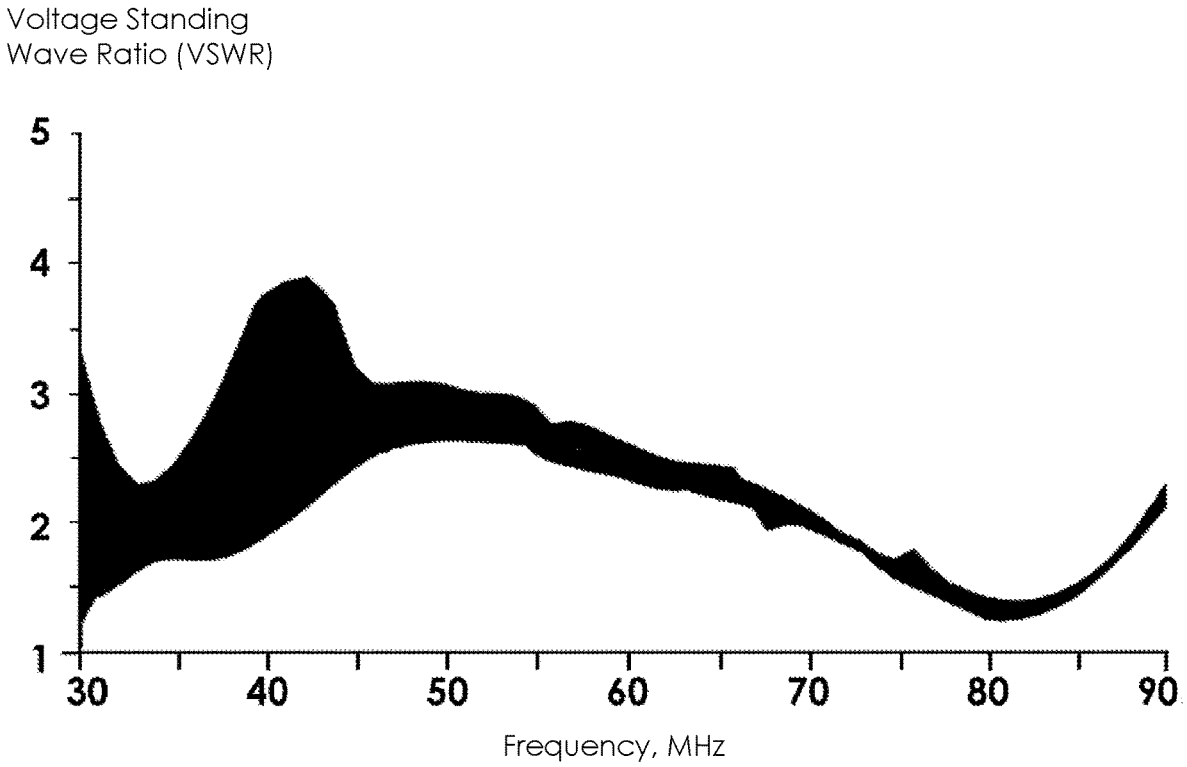
FIG. 20 is a graphical representation of an antenna matching/soil-type compensation network with an envelope of VSWR curves obtained with a staked antenna mounted over various soil types.

FIG. 19 and FIG. 20 depict the performance of the matching network over numerous soil types. FIG. 19 is a graphical representation of an antenna matching/soil-type compensation network with an envelope of VSWR curves obtained with an un-staked antenna mounted over various soil types and FIG. 20 is a graphical representation of an antenna matching/soil-type compensation network with an envelope of VSWR curves obtained with a staked antenna mounted over various soil types. There is a marked improvement in the match when the wire radials 18 are attached to ground stakes.

FIG. 21-29 are the vertical or elevation plane beam patterns of the antenna 10 over selected soil types. The beam patterns in the horizontal (or azimuth) plane are omnidirectional and are not shown. The figures also indicate that, particularly for dry soil, the attachment of ground stakes to the radials increases the power gain at frequencies below the geometric mean (the maximum increase being about 2 dB).

Figure 21:
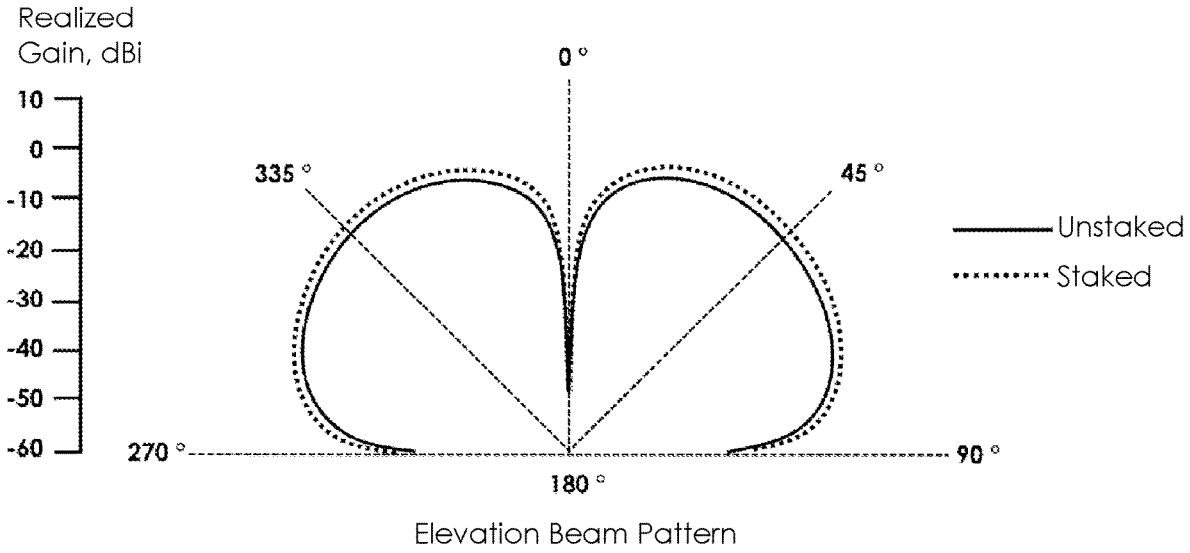
FIG. 21 depicts beam patterns over dry soil at a lower band edge of 30 MHz.
Figure 22:
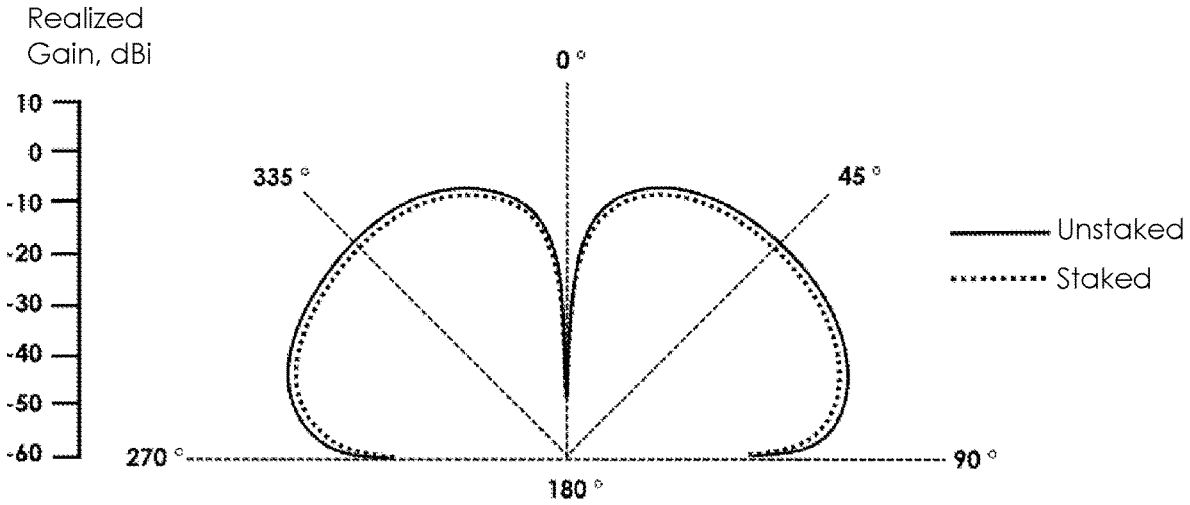
FIG. 22 depicts beam patterns over rich soil at a lower band edge of 30 MHz.
Figure 23:
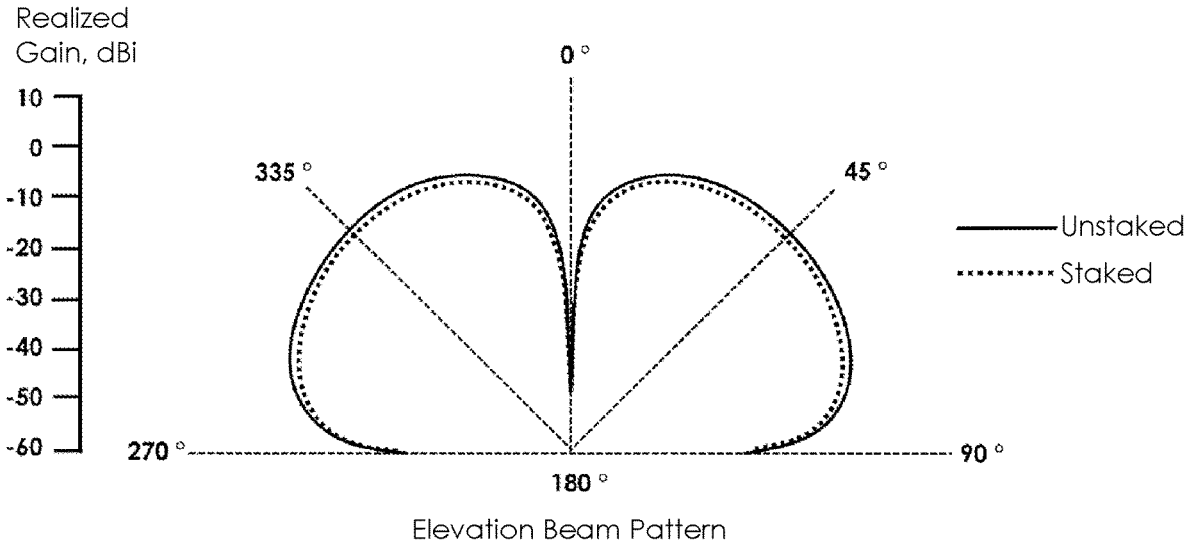
FIG. 23 depicts beam patterns over wet soil at a lower band edge of 30 MHz.

FIG. 21 depicts beam patterns over dry soil at a lower band edge of 30 MHz; FIG. 22 depicts beam patterns over rich soil at a lower band edge of 30 MHz and FIG. 23 depicts beam patterns over wet soil at a lower band edge of 30 MHz.

Figure 24:
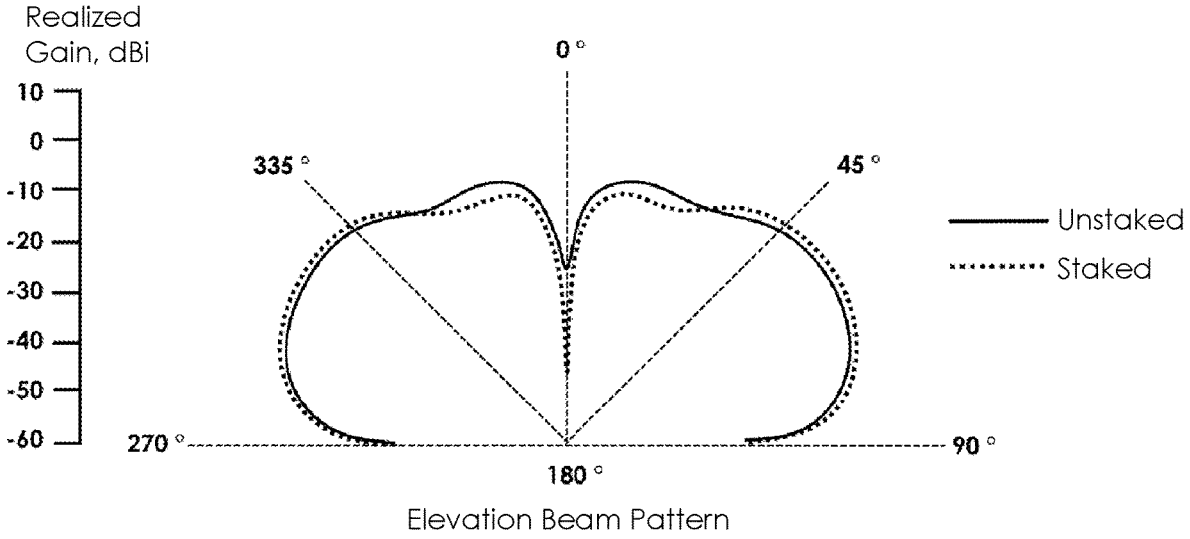
FIG. 24 depicts beam patterns over dry soil at the geometric mean frequency of 52 MHz.
Figure 25:
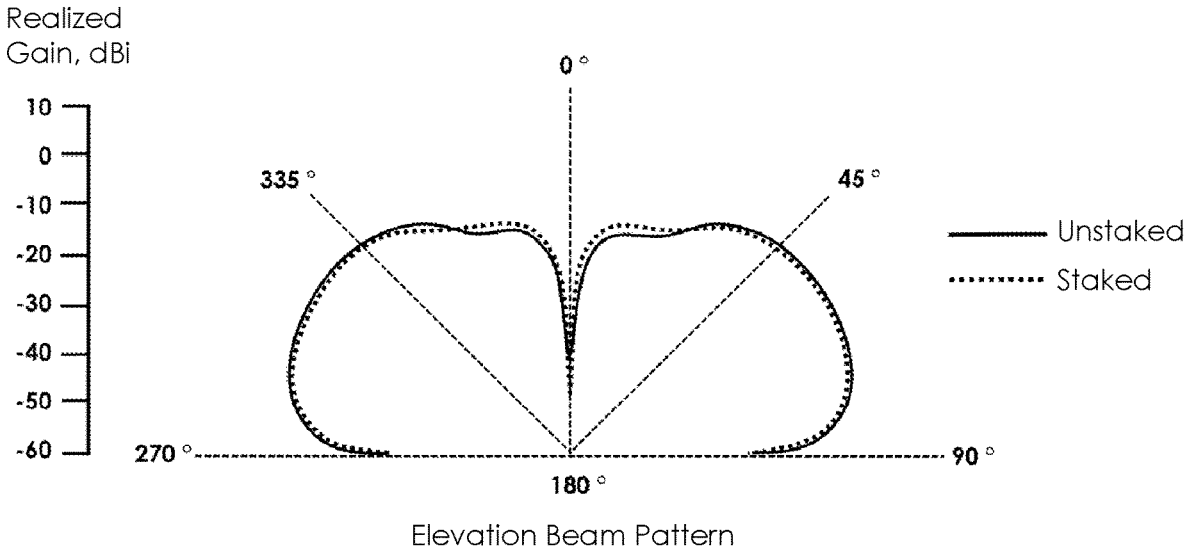
FIG. 25 depicts beam patterns over rich soil at the geometric means frequency of 52 MHz.
Figure 26:
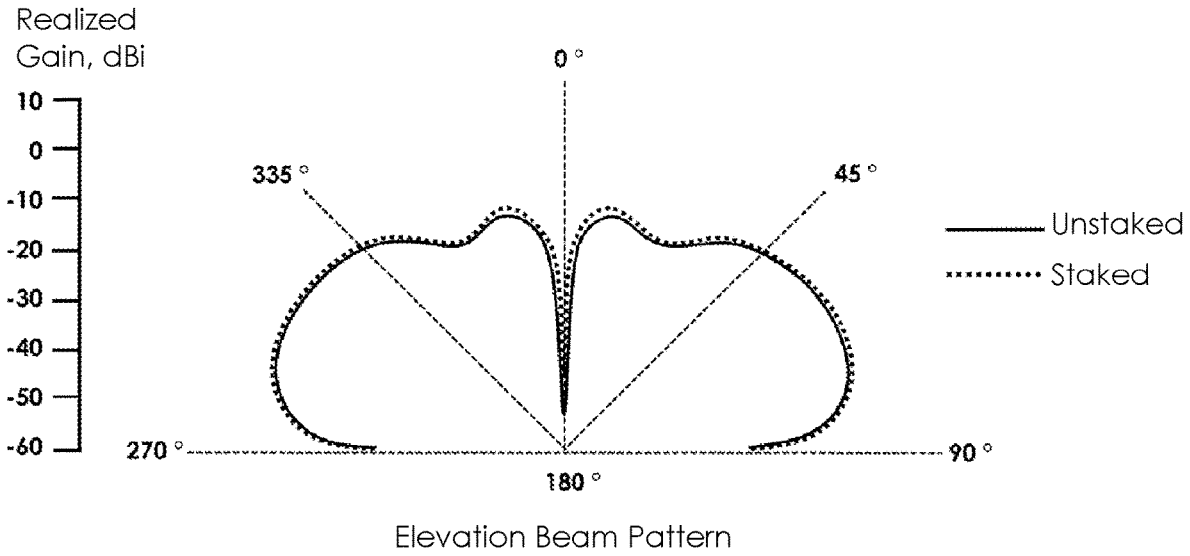
FIG. 26 depicts beam patterns over wet soil at the geometric mean frequency of 52 MHz.

FIG. 24 depicts beam patterns over dry soil at the geometric mean of 52 MHz; FIG. 25 depicts beam patterns over rich soil at the geometric mean of 52 MHz and FIG. 26 depicts beam patterns over wet soil at the geometric mean of 52 MHz.

Figure 27:
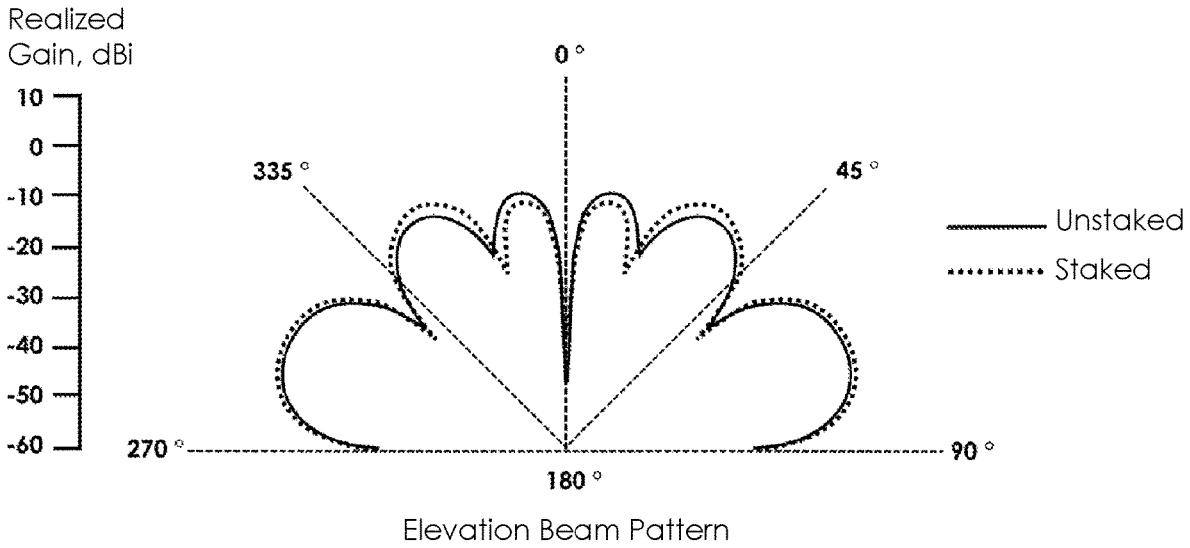
FIG. 27 depicts beam patterns over dry soil at the upper band edge of 88 MHz.
Figure 28:
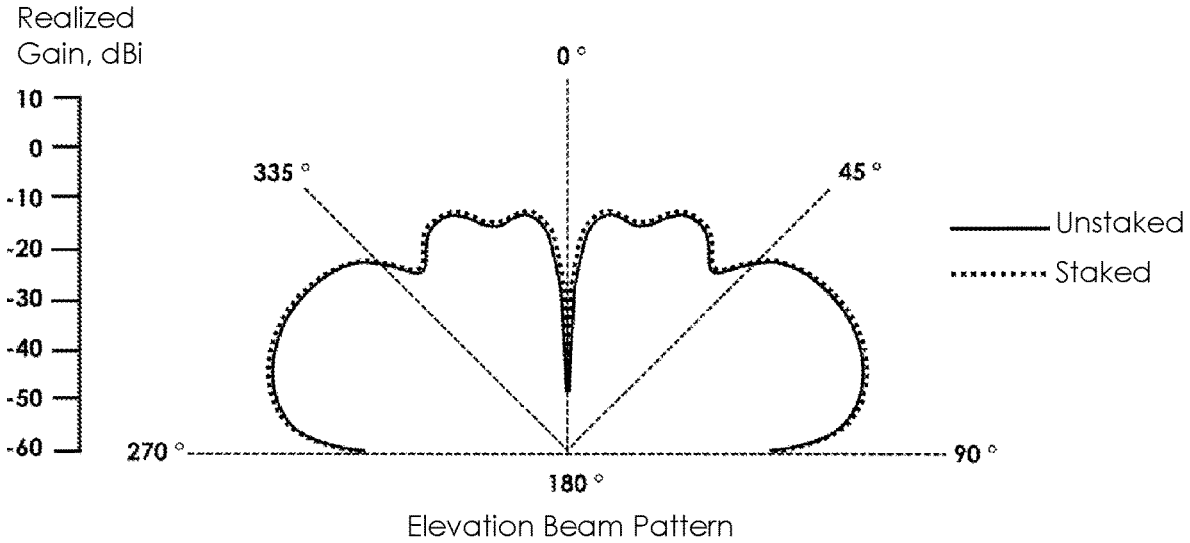
FIG. 28 depicts beam patterns over rich soil at the upper band edge of 88 MHz.
Figure 29:
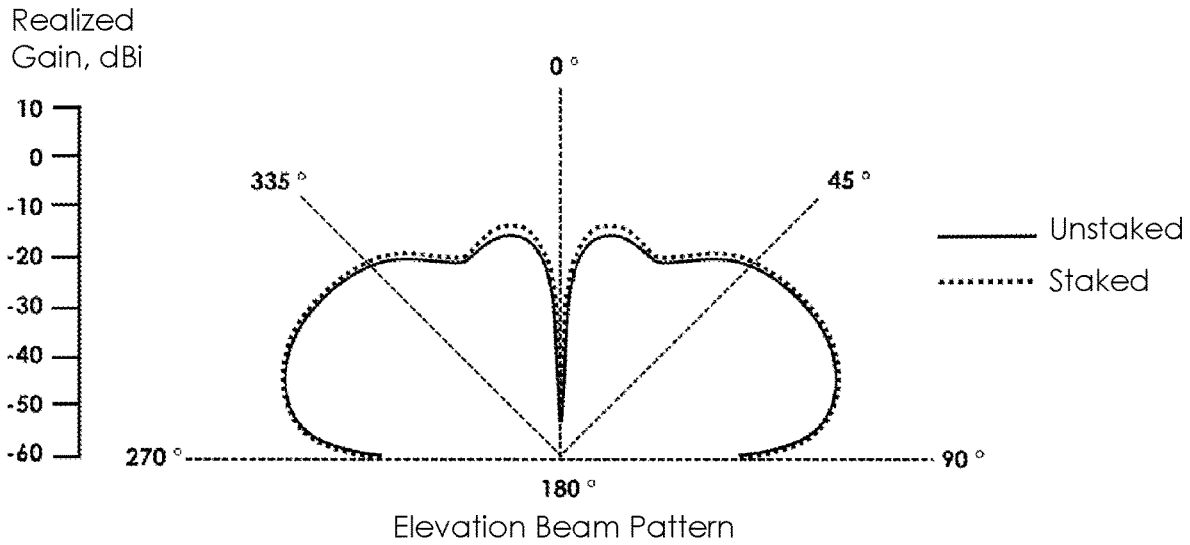
FIG. 29 depicts beam patterns over wet soil at the upper band edge of 88 MHz.

FIG. 27 depicts beam patterns over dry soil at the upper band edge of 88 MHz; FIG. 28 depicts beam patterns over rich soil at the upper band edge of 88 MHz and FIG. 29 depicts beam patterns over wet soil at an upper band edge of 88 MHz.

Advantages of the antenna 10 are that the antenna is lightweight and portable with a negligible wind area. The antenna 10 has a novel radiator shape with a wide instantaneous operating bandwidth (3:1) yet the antenna is economical to build and maintain. The antenna 10 is able to electrically self-adjust to account for differing soil types resulting in consistent performance.

It should be recognized that, in the light of the above teachings, those skilled in the art could modify those specifics without departing from the invention taught herein. Having now fully set forth certain embodiments and modifications of the concept underlying the present disclosure, various other embodiments as well as potential variations and modifications of the embodiments shown and described herein will obviously occur to those skilled in the art upon becoming familiar with such underlying concept. It is intended to include all such modifications, alternatives, and other embodiments insofar as they come within the scope of the appended claims or equivalents thereof. It should be understood, therefore, that the invention might be practiced otherwise than as specifically set forth herein. Consequently, the present embodiments are to be considered in all respects as illustrative and not restrictive.

What is claimed is:

1. An antenna comprising:

a semi-rectangular metal base plate wherein said base plate is capable of providing stability when said base plate is placed on a terrain;

a rectangular loop section positioned perpendicular to said base plate with said loop section having a semi-triangular taper at an end facing said base plate;

at least two rods of insulating material extending from said base plate to vertically lock said loop section into place in relation to said base plate;

at least eight thin wire radials attached to and extending horizontally from said base plate with another end of each of said wire radials capable of connection to a metal stake secured within the terrain of the Earth;

a metal clamp affixing the taper of said loop section to said base plate;

an S-shaped metal plate electrically connected to one end of said metal clamp and having an input jack integral to and electrically connected to a face at another end of said metal plate; and an L-shaped standoff insulator positioned between said base plate and said S-shaped metal plate wherein said L-shaped standoff insulator, said S-shaped plate and said base plate form a transmission line that carries power from the input jack to the loop section for reception and transmission from said antenna.

2. The antenna in accordance with claim 1, wherein said loop section is formed with stainless steel round wire with a diameter of 0.25 inches.

3. The antenna in accordance with claim 2, wherein said rods are made from FR-4 fiberglass.

4. The antenna in accordance with claim 1, wherein said base plate further comprises at least two rectangular sections horizontally protruding from a perimeter of said base plate wherein said rectangular sections are capable of providing additional stability for said antenna on the terrain.

5. The antenna in accordance with claim 4, wherein said base plate is fabricated from 0.25 inch thick aluminum.

6. The antenna in accordance with claim 4, wherein said transmission line produces a characteristic impedance of 50 ohms.

7. The antenna in accordance with claim 6, wherein said loop section has a height of 0.3λ and a width of 0.058λ as fractions of a wavelength.

8. The antenna in accordance with claim 7, wherein dimensions of said loop section are determined at a wavelength corresponding to a geometric mean frequency of the band ($\lambda_o$) as calculated by $$\lambda_o = \frac{v_o}{f_o}$$

where $v_o$ is the speed of light and where $f_o$ is the geometric mean frequency wherein the loop width and feed taper angle proportions present an impedance at said input jack that can match a transceiver.

* * * * *